US008875682B2

(12) United States Patent
Di Domizio et al.

(10) Patent No.: US 8,875,682 B2
(45) Date of Patent: Nov. 4, 2014

(54) COUPLING DEVICE AND FUEL INJECTION ARRANGEMENT

(75) Inventors: Gisella Di Domizio, San Giuliano Terme (IT); Giandomenico Serra, Loc.Ghezzano-S.Giuliano Terme (IT)

(73) Assignee: Continental Automotive GmbH, Hannover (DE)

( * ) Notice: Subject to any disclaimer, the term of this patent is extended or adjusted under 35 U.S.C. 154(b) by 1058 days.

(21) Appl. No.: 12/763,329

(22) Filed: Apr. 20, 2010

(65) Prior Publication Data

US 2010/0313851 A1 Dec. 16, 2010

(30) Foreign Application Priority Data

Apr. 20, 2009 (EP) ..... 09005550

(51) Int. Cl.
*F02M 61/14* (2006.01)
*F02M 55/02* (2006.01)
*F02M 55/00* (2006.01)

(52) U.S. Cl.
CPC ..... *F02M 55/004* (2013.01); *F02M 55/025* (2013.01); *F02M 55/02* (2013.01); *F02M 2200/856* (2013.01); *F02M 2200/852* (2013.01); *F02M 55/005* (2013.01)
USPC ..... 123/470; 123/456; 123/469

(58) Field of Classification Search
USPC ..... 123/456, 469, 470
See application file for complete search history.

(56) References Cited

U.S. PATENT DOCUMENTS

| | | | | |
|---|---|---|---|---|
| 4,307,693 | A * | 12/1981 | Glockler et al. | 123/470 |
| 5,803,052 | A * | 9/1998 | Lorraine et al. | 123/470 |
| 5,970,953 | A * | 10/1999 | Lorraine et al. | 123/470 |
| 6,382,187 | B1 * | 5/2002 | Scollard et al. | 123/470 |
| 6,668,803 | B1 * | 12/2003 | McClean et al. | 123/470 |
| 7,360,524 | B2 * | 4/2008 | Zdroik et al. | 123/470 |

(Continued)

FOREIGN PATENT DOCUMENTS

| | | | |
|---|---|---|---|
| DE | 10 2007 003 842 | 8/2007 | F02M 55/02 |
| EP | 2 093 411 | 8/2009 | F02M 55/00 |
| EP | 2 103 804 | 9/2009 | F02M 55/00 |

OTHER PUBLICATIONS

European Search Report, European application No. 09005550.0-2311, 5 pages, Nov. 13, 2009.

*Primary Examiner* — Hieu T Vo
*Assistant Examiner* — Sherman Manley
(74) *Attorney, Agent, or Firm* — King & Spalding L.L.P.

(57) ABSTRACT

A coupling device for hydraulically and mechanically coupling an injection valve to a fuel rail of a combustion engine has a fuel injector cup with a central longitudinal axis, is hydraulically coupled to the fuel rail and in engagement with the injection valve. A first retaining element is fixedly coupled to the fuel injector cup, a second retaining element is fixedly coupled to the injection valve, the second retaining element being coupled to the first retaining element to prevent a movement of the second retaining element relative to the first retaining element in a first direction of the central longitudinal axis to retain the injection valve in the fuel injector cup, and an interface element which is operable to axially couple the injection valve with the second retaining element in a fixed way. Fuel injection arrangement with a coupling device and an injection valve which is coupled to the coupling device.

15 Claims, 4 Drawing Sheets

(56) References Cited

U.S. PATENT DOCUMENTS

| | | | | |
|---|---|---|---|---|
| 7,415,970 | B2 * | 8/2008 | Zdroik et al. | 123/470 |
| 7,765,984 | B2 * | 8/2010 | Fuerst et al. | 123/456 |
| 7,802,559 | B2 * | 9/2010 | Furst et al. | 123/470 |
| 2006/0137659 | A1 * | 6/2006 | Zdroik et al. | 123/470 |
| 2008/0302336 | A1 * | 12/2008 | Fuerst et al. | 123/470 |
| 2009/0056674 | A1 * | 3/2009 | Furst et al. | 123/470 |
| 2009/0230677 | A1 | 9/2009 | Mannucci et al. | 285/318 |
| 2009/0235899 | A1 | 9/2009 | Biasci et al. | 123/470 |

* cited by examiner

FIG 3
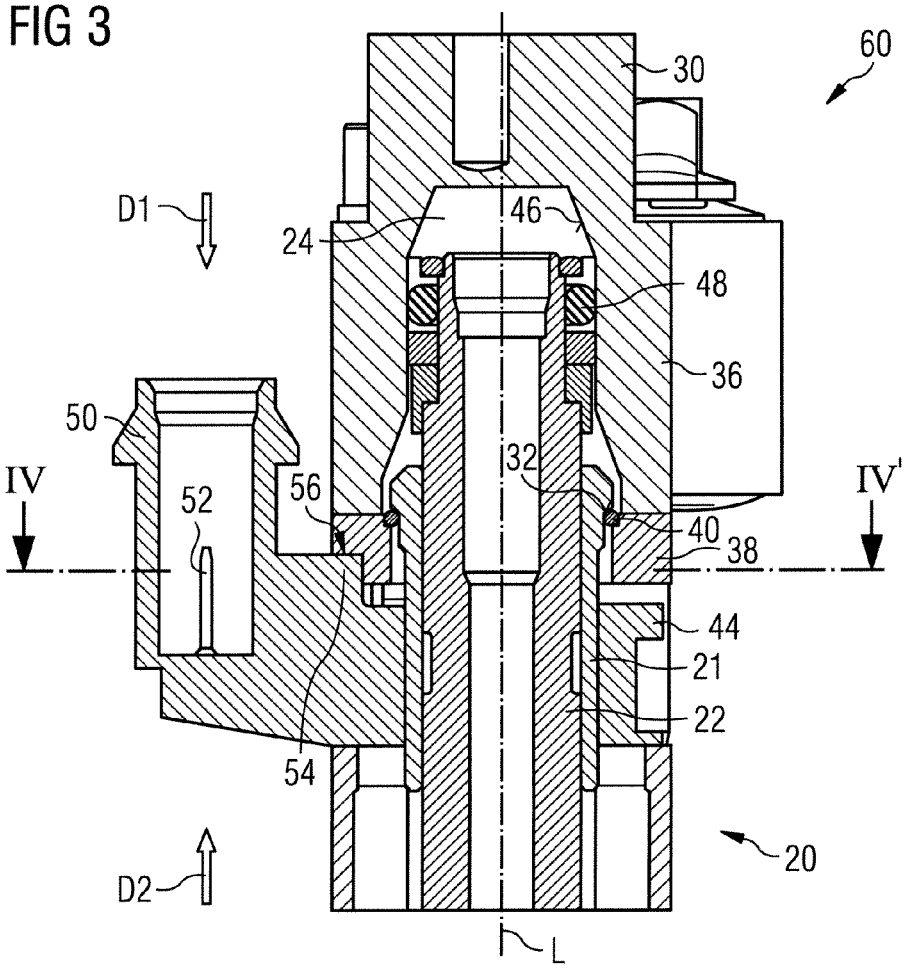
FIG 4 IV-IV'
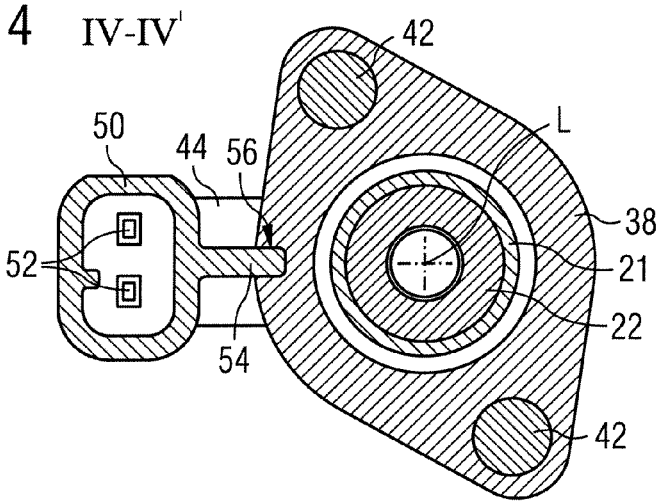

COUPLING DEVICE AND FUEL INJECTION ARRANGEMENT

CROSS-REFERENCE TO RELATED APPLICATIONS

This application claims priority to EP Patent Application No. 09005550 filed Apr. 20, 2009, the contents of which is incorporated herein by reference in its entirety.

TECHNICAL FIELD

The invention relates to a coupling device for hydraulically and mechanically coupling a fuel injector to a fuel rail of a combustion engine, and a fuel injection arrangement.

BACKGROUND

Coupling devices for hydraulically and mechanically coupling a fuel injector to a fuel rail are in widespread use, in particular for internal combustion engines. Fuel can be supplied to an internal combustion engine by the fuel injection arrangement through the fuel injector. The fuel injectors can be coupled to the fuel injector cups in different manners.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail.

Known fuel rails comprise a hollow body with recesses in form of fuel injector cups, wherein the fuel injectors are arranged. The connection of the fuel injectors to the fuel injector cups that supply the fuel from a fuel tank via a low or high-pressure fuel pump needs to be very precise to get a correct injection angle and a sealing of the fuel.

SUMMARY

According to various embodiments, a coupling device for hydraulically and mechanically coupling a fuel injector to a fuel rail and a fuel injection arrangement can be created which are simply to be manufactured and which facilitate a reliable and precise connection between the fuel injector and the fuel injector cup without a resting of the fuel injector on the cylinder head.

According to an embodiment, a coupling device for hydraulically and mechanically coupling an injection valve to a fuel rail of a combustion engine may comprise a fuel injector cup having a central longitudinal axis and being designed to be hydraulically coupled to the fuel rail and being operable to be in engagement with the injection valve, a first retaining element being fixedly coupled to the fuel injector cup, a second retaining element being fixedly coupled to the injection valve, the second retaining element being coupled to the first retaining element to prevent a movement of the second retaining element relative to the first retaining element in a first direction of the central longitudinal axis to retain the injection valve in the fuel injector cup, and an interface element being operable to axially couple the injection valve with the second retaining element in a fixed way.

According to a further embodiment, the interface element and the second retaining element can be form-fit coupled. According to a further embodiment, the interface element may have a tab extending in axial direction and the second retaining element may have a recess, and the tab being in engagement with the recess. According to a further embodiment, the interface element and the second retaining element can be designed to prevent a rotational movement of the injection valve relative to the fuel injector cup in view of the central longitudinal axis. According to a further embodiment, the tab and the recess can be arranged and designed to prevent a rotational movement of the injection valve relative to the fuel injector cup in view of the central longitudinal axis. According to a further embodiment, the interface element may comprise an electrical connector being designed for an electrical supply of the injection valve.

According to another embodiment, a fuel injection arrangement may comprise a coupling device as described above and an injection valve being coupled to the coupling device.

BRIEF DESCRIPTION OF THE DRAWINGS

Exemplary embodiments are explained in the following with the aid of schematic drawings. These are as follows.

Elements of the same design and function that occur in different illustrations are identified by the same reference character.

DETAILED DESCRIPTION

Figure 1:
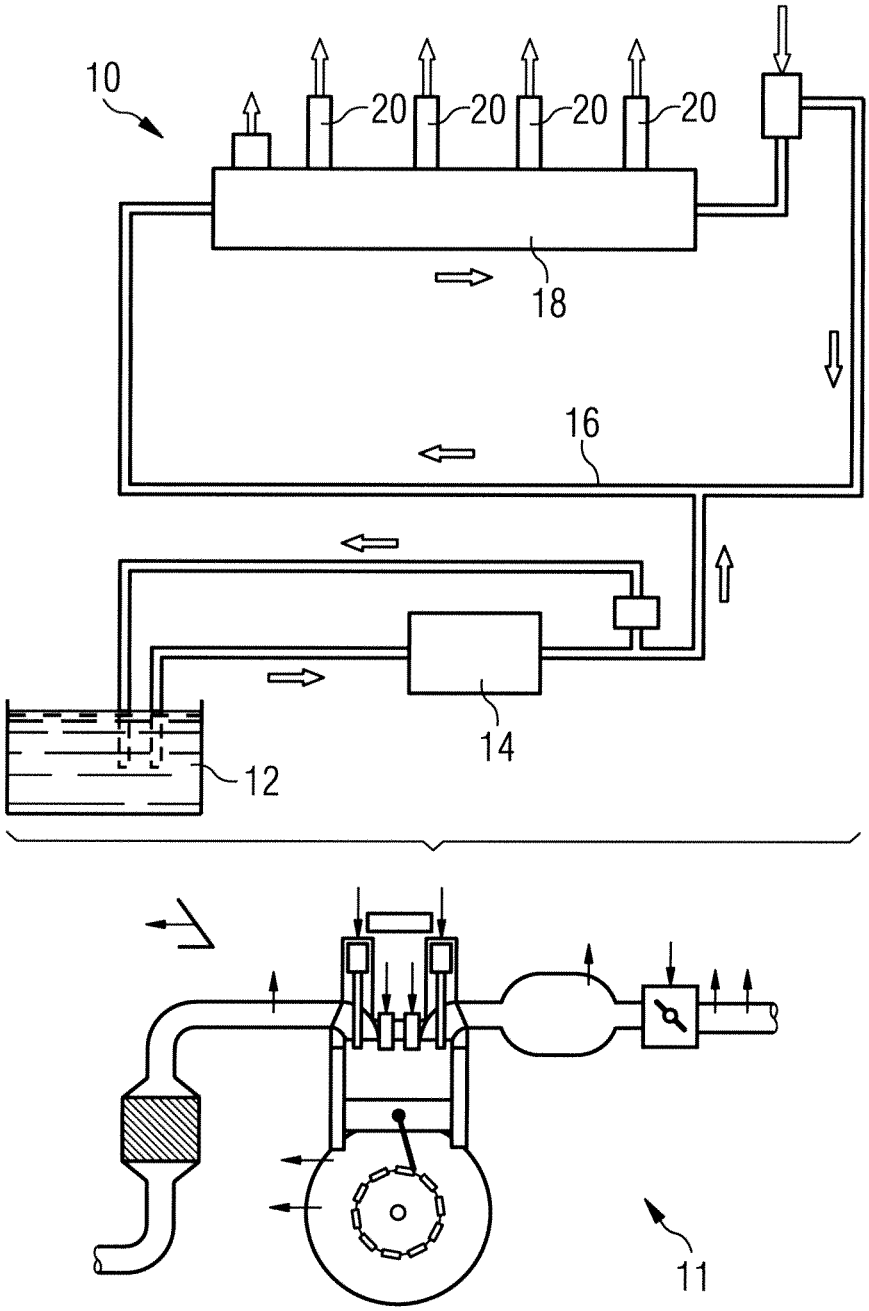
FIG. 1 an internal combustion engine in a schematic view.

According to a first aspect, a coupling device for hydraulically and mechanically coupling a fuel injector to a fuel rail of a combustion engine may comprise a fuel injector cup having a central longitudinal axis and being designed to be hydraulically coupled to the fuel rail and being operable to be in engagement with the injection valve, a first retaining element being fixedly coupled to the fuel injector cup, a second retaining element being fixedly coupled to the injection valve, the second retaining element being coupled to the first retaining element to prevent a movement of the second retaining element relative to the first retaining element in a first direction of the central longitudinal axis to retain the injection valve in the fuel injector cup, and an interface element. The interface element is operable to axially couple the injection valve with the second retaining element in a fixed way.

The interface element is designed to limit a movement of the injection valve relative to the fuel injector cup in a second direction of the central longitudinal axis opposing the first direction.

This has the advantage that only a little movement of the injection valve towards the injector cup, which means in the second direction, is possible. Furthermore, the mounting and the assembly of the coupling device can be carried out in a simple manner. Additionally, low costs for the coupling device can be obtained.

In an embodiment the interface element and the second retaining element are form-fit coupled. In a further embodiment the interface element has a tab extending in axial direction and the second retaining element has a recess. The tab is in engagement with the recess. This has the advantage that the rest position of the injection valve relative to the injector cup can be adjusted and the movement of the injection valve towards the injector cup can be limited in a very simple manner.

In a further embodiment the interface element and the second retaining element are designed to prevent a rotational movement of the injection valve relative to the fuel injector cup in view of the central longitudinal axis. This has the advantage that a limitation of the axial and rotational movement of the injection valve towards the injector cup is possible with a single element. Consequently, a desired orientation of the fuel spray structure can be obtained.

In a further embodiment the tab and the recess are arranged and designed to prevent a rotational movement of the injection valve relative to the fuel injector cup in view of the central longitudinal axis. This has the advantage that the limitation of the axial and rotational movement of the injection valve towards the injector cup can be obtained by simple means.

In a further embodiment the interface element comprises an electrical connector being designed for an electrical supply of the injection valve. This has the advantage that it is possible to avoid the use of further parts for the interface element, as for example the interface element can be overmolded in one part with the electrical connector. Furthermore, it is a simple way to limit the movement of the injection valve towards the injector cup by mounting an element outside the injection valve.

According to a second aspect, may comprise a fuel injection arrangement with a coupling device in accordance to the first aspect and an injection valve being coupled to the coupling device.

A fuel feed device 10 is assigned to an internal combustion engine 11 (FIG. 1) which can be a diesel engine or a gasoline engine. It includes a fuel tank 12 that is connected via a first fuel line to a fuel pump 14. The output of the fuel pump 14 is connected to a fuel inlet 16 of a fuel rail 18. In the fuel rail 18, the fuel is stored for example under a pressure of about 200 bar in the case of a gasoline engine or of about more than 2,000 bar in the case of a diesel engine. Fuel injectors 20 are connected to the fuel rail 18 and the fuel is fed to the fuel injectors 20 via the fuel rail 18.

Figure 2:
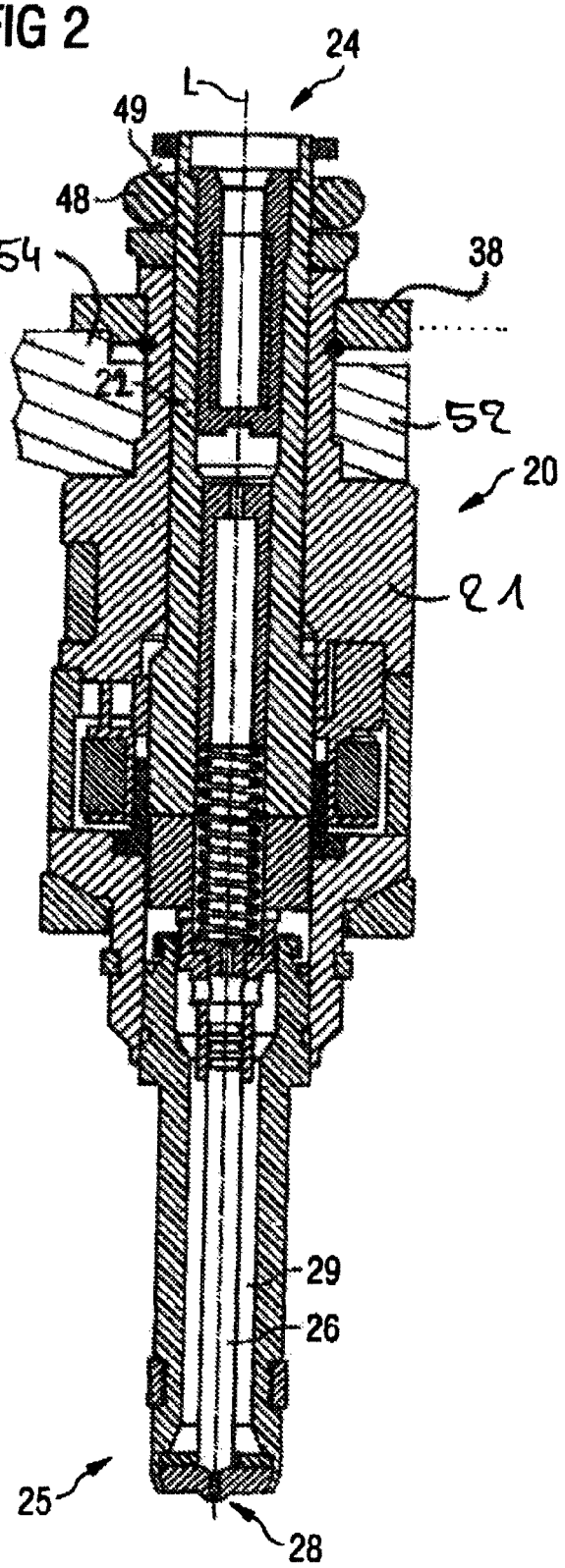
FIG. 2 a longitudinal section through a fuel injection arrangement with a fuel injector, FIG. 3 a longitudinal section through a coupling device, FIG. 4 the coupling device along the line IV-IV' of FIG. 3 in a section view, and FIG. 5 a further longitudinal section through the coupling device.

FIG. 2 shows a fuel injection arrangement with the fuel injector 20 in detail. The fuel injector 20 is suitable for injecting fuel into a combustion chamber of the internal combustion engine 11. The fuel injector 20 comprises a central longitudinal axis L and has a valve body 21. Inside the valve body 21 a fuel inlet tube 22 is arranged partially. The fuel inlet tube comprises a fuel inlet portion 24 of the fuel injector 20. Furthermore, the fuel injector 20 has a fuel outlet portion 25.

The fuel injector 20 comprises a valve needle 26 taken in a cavity 29 of an end portion of the fuel injector. On a free end of the fuel injector 20 an injection nozzle 28 is formed which is closed or opened depending on the position of the valve needle 26 due to an axial movement of the valve needle 26. In a closing position of the valve needle 26 a fuel flow through the injection nozzle 28 is prevented. In an opening position fuel can flow through the injection nozzle 28 into a combustion chamber of the internal combustion engine 11.

Figure 5:
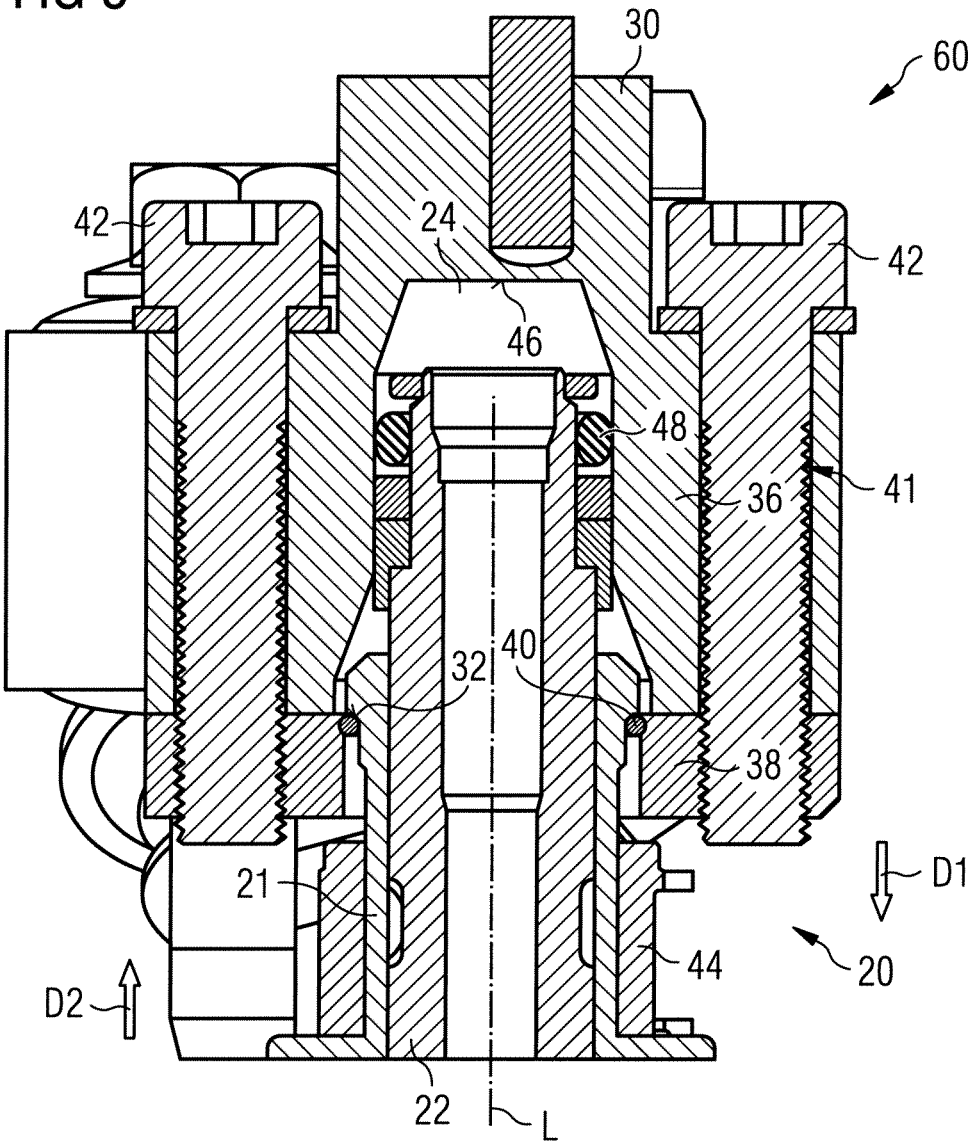

FIGS. 3 to 5 show a coupling device 60 which is coupled to the fuel rail 18 of the internal combustion engine 11. The fuel injector 20 has a groove 32. The coupling device 60 comprises a fuel injector cup 30, a first retaining element 36 and a second retaining element 38, a snap ring 40 arranged in the groove 32, at least one screw 42 and an interface element 44, the parts of the coupling device 60 being described in the following.

The fuel injector cup 30 is hydraulically coupled to the fuel rail 18. The fuel injector cup 30 has an inner surface 46. Furthermore, the fuel injector cup 30 is in engagement with the fuel inlet tube 22 of the fuel injector 20.

On an outer surface of the fuel inlet tube 22 a sealing ring 48 is arranged which is in sealing contact with the inner surface 46 of the fuel injector cup 30. Additionally, further rings are arranged radially between the outer surface of the fuel inlet tube 22 and the inner surface 46 of the fuel injector cup 30.

The first retaining element 36 is in one piece with the fuel injector cup 30. In further embodiments the first retaining element 36 can be a separate part which is fixedly coupled to the fuel injector cup 30.

The second retaining element 38 is in engagement with the snap ring 40 which is arranged in the groove 32 of the fuel injector 20. Preferably, the snap ring 40 can be an open C-shaped ring (for example a 270° ring) which can be arranged in the groove 32 of the fuel injector 20 by inclining the second retaining element 38 relative to the injection valve 20 and shifting the snap ring 40 into its final position in the groove 32. The snap ring 40 enables a positive fitting coupling between the second retaining element 38 and the fuel injector 20. Consequently, the second retaining element 38 is fixedly coupled to the fuel injector 20.

Preferably, the first retaining element 36 may have one or more through holes 41. The first retaining element 36 and the second retaining element 38 are fixedly coupled with each other by the one screw 42 or several screws 42 which are received by the through holes 41 of the first retaining element 36 and are screwed into the second retaining element 38. This prevents a movement of the second retaining element 38 relative to the first retaining element 36 in a first direction D1.

The positive fitting coupling between the second retaining element 38 and the fuel injector 20 prevents a movement of the fuel injector 20 relative to the second retaining element 38 in the first direction D1.

As the first retaining element 36 is fixedly coupled to the fuel injector cup 30, the second retaining element 38 is fixedly coupled to the fuel injector 20 and the first retaining element 36 is fixedly coupled to the second retaining element 38, the fuel injector 20 is retained in the fuel injector cup 30 in direction of the central longitudinal axis L. This arrangement is also named a suspended fuel injector.

The injection valve 20 has an electrical connector 50 which serves for an electrical supply of the injection valve 20. The electrical connector 50 comprises pins 52 which are electrically coupled with an actuator unit of the injection valve 20. A power supply can be coupled to the pins 52 to supply the actuator unit with electrical energy.

The interface element 44 is arranged axially between parts of the injection valve 20 and the second retaining element 38 (FIG. 3). The interface element 44 comprises the electrical connector 50. In the shown embodiment the interface element 44 is in one part with the electrical connector 50. In further embodiments, the electrical connector 50 can be a separate part which is fixedly coupled to the interface element 44.

At its lower end facing the injection nozzle 28 the interface element 44 is in engagement with the injection valve 20.

The interface element 44 comprises a tab 54 which extends in axial direction. The second retaining element 38 has a recess 56. The tab 54 is in engagement with the recess 56. By this, a positive fitting coupling between the interface element 44 and the second retaining element 38 can be obtained. The interface element 44 limits the movement of the injection valve 20 relative to the fuel injector cup 30 in a second direction D2 of the central longitudinal axis L. The first direction D1 and the second direction D2 are opposing directions of the central longitudinal axis L (FIG. 3).

Consequently, the movement of the injection valve 20 in the second direction D2 towards the fuel injector cup 30 can be kept very small. Due to the interface element 44 the injection valve 20 can be kept easily in its rest position relative to the fuel injector cup 30 even in the case that the pressure in the combustion chamber is higher than the fuel pressure in the fuel rail 18.

As can be seen FIG. 4 the recess 56 has a limited extension in circumferential direction of the retaining element 38 and the tab 54 is in close contact with the surfaces of the recess 56.

Therefore, a circumferential movement of the tab 54 relative to the retaining element 38 can be prevented. Consequently, a rotational movement of the injection valve 20 relative to the fuel injector cup 30 in view of the central longitudinal axis L can be prevented very easily. Altogether it is possible to limit the axial movement as well as the rotation of the fuel injector 20 relative to the injector cup 30 with the single combination of the recess 56 with the tab 54. Therefore, it is very simple to obtain a well-defined orientation of the distribution of the spray inside the combustion chamber of the internal combustion engine 11.

Additionally, the mounting and the assembly of the fuel rail can be carried out in a secure manner as the interface element 44 holds the valve body 21 in a close contact with the snap ring 40 as well as the snap ring 40 in a close contact with the second retaining element 38.

What is claimed is:

1. A coupling device for hydraulically and mechanically coupling an injection valve to a fuel rail of a combustion engine comprising:

a fuel injector cup having a central longitudinal axis and being designed to be hydraulically coupled to the fuel rail and being operable to be in engagement with the injection valve, a first retaining element being fixedly coupled to the fuel injector cup, a second retaining element being fixedly coupled to the injection valve, the second retaining element being screwed to the first retaining element to prevent a movement of the second retaining element relative to the first retaining element in a first direction of the central longitudinal axis to retain the injection valve in the fuel injector cup, and an interface element being operable to axially couple the injection valve with the second retaining element in a fixed way, wherein the interface element has a tab extending in axial direction and the second retaining element has a recess, wherein the tab engages with the recess, and wherein the interface element comprises an electrical connector configured for an electrical supply of the injection valve.

2. The coupling device according to claim 1, wherein the interface element and the second retaining element are form-fit coupled.

3. The coupling device according to claim 1, wherein the interface element and the second retaining element are designed to prevent a rotational movement of the injection valve relative to the fuel injector cup in view of the central longitudinal axis.

4. The coupling device according to claim 1, wherein the tab and the recess are arranged and designed to prevent a rotational movement of the injection valve relative to the fuel injector cup in view of the central longitudinal axis.

5. A fuel injection arrangement comprising:

a coupling device, and an injection valve being coupled to the coupling device, wherein the coupling device comprises:

a fuel injector cup having a central longitudinal axis and being designed to be hydraulically coupled to a fuel rail and being operable to be in engagement with the injection valve, a first retaining element being fixedly coupled to the fuel injector cup, a second retaining element being fixedly coupled to the injection valve, the second retaining element being screwed to the first retaining element to prevent a movement of the second retaining element relative to the first retaining element in a first direction of the central longitudinal axis to retain the injection valve in the fuel injector cup, and an interface element being operable to axially couple the injection valve with the second retaining element in a fixed way, wherein the interface element has a tab extending in axial direction and the second retaining element has a recess, wherein the tab engages with the recess, and wherein the interface element comprises an electrical connector configured for an electrical supply of the injection valve.

6. The fuel injection arrangement according to claim 5, wherein the interface element and the second retaining element are form-fit coupled.

7. The fuel injection arrangement according to claim 5, wherein the interface element and the second retaining element are designed to prevent a rotational movement of the injection valve relative to the fuel injector cup in view of the central longitudinal axis.

8. The fuel injection arrangement according to claim 5, wherein the tab and the recess are arranged and designed to prevent a rotational movement of the injection valve relative to the fuel injector cup in view of the central longitudinal axis.

9. A method for hydraulically and mechanically coupling an injection valve to a fuel rail of a combustion engine comprising:

providing a fuel injector cup having a central longitudinal axis and being designed to be hydraulically coupled to the fuel rail and being operable to be in engagement with the injection valve, fixedly coupling a first retaining element 36 to the fuel injector cup 30 and fixedly coupling a second retaining element to the injection valve, wherein the second retaining element being screwed to the first retaining element to prevent a movement of the second retaining element relative to the first retaining element in a first direction of the central longitudinal axis to retain the injection valve in the fuel injector cup, and axially coupling the injection valve with the second retaining element in a fixed way by engaging an axially-extending tab of an interface element into a recess of the second retaining element, wherein the interface element comprises an electrical connector configured for an electrical supply of the injection valve.

10. The method according to claim 9, wherein the interface element and the second retaining element are form-fit coupled.

11. The method according to claim 9, wherein the interface element and the second retaining element prevent a rotational movement of the injection valve relative to the fuel injector cup in view of the central longitudinal axis.

12. The method according to claim 9, wherein the tab and the recess are arranged and designed to prevent a rotational movement of the injection valve relative to the fuel injector cup in view of the central longitudinal axis.

13. The method according to claim 9, further comprising the step of coupling the coupling device with an injection valve in a fuel injection arrangement.

14. A coupling device for hydraulically and mechanically coupling an injection valve to a fuel rail of a combustion engine comprising:

a fuel injector cup having a central longitudinal axis and being designed to be hydraulically coupled to the fuel rail and being operable to be in engagement with the injection valve, a first retaining element being fixedly coupled to the fuel injector cup, a second retaining element being fixedly coupled to the injection valve, the second retaining element being screwed to the first retaining element to prevent a movement of the second retaining element relative to the first retaining element in a first direction of the central longitudinal axis to retain the injection valve in the fuel injector cup, and an interface element being operable to axially couple the injection valve with the second retaining element in a fixed way, wherein the interface element has a tab extending in axial direction and the second retaining element has a recess, wherein the tab engages with the recess, and wherein the interface element comprises an electrical connector configured for an electrical supply of the injection valve.

15. A fuel injection arrangement comprising:

a coupling device, and an injection valve being coupled to the coupling device, wherein the coupling device comprises:

a fuel injector cup having a central longitudinal axis and being designed to be hydraulically coupled to a fuel rail and being operable to be in engagement with the injection valve, a first retaining element being fixedly coupled to the fuel injector cup, a second retaining element being fixedly coupled to the injection valve, the second retaining element being screwed to the first retaining element via at least a first screw to prevent a movement of the second retaining element relative to the first retaining element in a first direction of the central longitudinal axis to retain the injection valve in the fuel injector cup, and an interface element being operable to axially couple the injection valve with the second retaining element in a fixed way, wherein the interface element has a tab extending in axial direction and the second retaining element has a recess, wherein the tab engages with the recess, and wherein the interface element comprises an electrical connector configured for an electrical supply of the injection valve.

* * * * *